US007559814B2

(12) United States Patent
Gremminger et al.

(10) Patent No.: US 7,559,814 B2
(45) Date of Patent: Jul. 14, 2009

(54) TILT/TRIM ASSEMBLY AND METHOD

(75) Inventors: William Gremminger, Virginia Beach, VA (US); Emil Hasl, Virginia Beach, VA (US)

(73) Assignee: AB Volvo Penta, Gothenburg (SE)

( * ) Notice: Subject to any disclaimer, the term of this patent is extended or adjusted under 35 U.S.C. 154(b) by 0 days.

(21) Appl. No.: 11/815,825

(22) PCT Filed: Feb. 23, 2005

(86) PCT No.: PCT/US2005/005642

§ 371 (c)(1),
(2), (4) Date: Aug. 8, 2007

(87) PCT Pub. No.: WO2006/091193

PCT Pub. Date: Aug. 31, 2006

(65) Prior Publication Data

US 2008/0153368 A1 Jun. 26, 2008

(51) Int. Cl.
*B63H 5/125* (2006.01)

(52) U.S. Cl. ..... 440/61 T; 440/57; 440/61 R

(58) Field of Classification Search ..... 440/53, 440/55, 56, 57, 61 D, 61 R, 61 T
See application file for complete search history.

(56) References Cited

U.S. PATENT DOCUMENTS 3,888,203 A 6/1975 Lohse
3,933,116 A * 1/1976 Adams et al. ..... 440/57
3,957,011 A 5/1976 Hurst
4,086,869 A * 5/1978 Woodruff ..... 440/56
4,297,097 A 10/1981 Kiekhaefer
4,318,699 A 3/1982 Wenstadt et al.
4,449,945 A * 5/1984 Ferguson ..... 440/53
4,642,058 A * 2/1987 Sullivan ..... 440/61 R
4,950,189 A * 8/1990 Tahara et al. ..... 440/61 R
5,000,707 A 3/1991 Saitoh et al.
5,203,730 A 4/1993 Kuragaki
5,645,009 A 7/1997 Lexau
6,015,318 A 1/2000 Uematsu et al.
6,309,265 B1 * 10/2001 Oguma ..... 440/61 R

OTHER PUBLICATIONS

International Search Report for corresponding International Application PCT/US2005/005642, Aug. 17, 2005.
Written Opinion of International Preliminary Examining Authority dated Jul. 19, 2006, for corresponding International Application PCT/US2005/005642.
International Preliminary Report on Patentability dated Nov. 2, 2006, for corresponding International Application PCT/US2005/005642.

* cited by examiner

*Primary Examiner*—Lars A Olson
(74) *Attorney, Agent, or Firm*—WRB-IP LLP

(57) ABSTRACT

A transom shield assembly adapted to be coupled to a transom of an inboard/outboard boat includes a transom shield, and a cover, attachable to the transom shield, for covering a trim pump. The transom shield assembly permits a trim pump to be hydraulically connected to a trim cylinder to form a tilt/trim assembly and, after hydraulically connecting the trim pump to the trim cylinder to form a tilt/trim assembly, permits the tilt/trim assembly to be installed on the inboard/outboard boat without hydraulically disconnecting the trim pump and the trim cylinder.

23 Claims, 6 Drawing Sheets

TILT/TRIM ASSEMBLY AND METHOD

BACKGROUND AND SUMMARY

The present invention relates to inboard/outboard boats and, more particularly, to tilt/trim assemblies on inboard/outboard boats.

Basic components of conventional inboard/outboard boats are shown in U.S. Pat. No. 6,468,120, U.S. Pat. No. 6,468,119, and U.S. Pat. No. 6,585,545, all of which are incorporated by reference. In inboard/outboard boats, drive shafts and gears typically transmit power to a propeller of a stem drive unit outside of the boat from a drive such as an engine that is typically inside the hull of the boat. To turn the boat to port or starboard, the stem drive unit is mounted to a gimbal ring that can be pivoted about a generally vertical axis. To raise the stern drive unit relative to the boat, which may be desirable for various reasons, such as when operating in shallow water, the stem drive unit is ordinarily pivotable relative to the gimbal ring about a horizontal axis. To pivot the stem drive unit about the horizontal axis, it is typical to use a tilt/trim assembly including a hydraulic cylinder arrangement. It is desirable to simplify construction of inboard/outboard boats. It is also desirable to reduce the possibility of contamination of hydraulic fluid in the hydraulic cylinder arrangement.

In accordance with an aspect of the present invention, a transom shield assembly adapted to be coupled to a transom of an inboard/outboard boat comprises a transom shield, and a cover, attachable to the transom shield, for covering a trim pump.

In accordance with another aspect of the present invention, an inboard/outboard boat comprises a transom shield assembly adapted to be coupled to a transom of an inboard/outboard boat, the transom shield assembly comprising a transom shield, and a cover, attachable to the transom shield, for covering a trim pump.

In accordance with another aspect of the present invention, a method of assembling an inboard/outboard boat comprises hydraulically connecting a trim pump to a trim cylinder to form a tilt/trim assembly, installing the trim pump in a recess on a transom shield of the inboard/outboard boat, and, after hydraulically connecting the trim pump to the trim cylinder to form the tilt/trim assembly, installing the tilt/trim assembly on the inboard/outboard boat without hydraulically disconnecting the trim pump and the trim cylinder.

In accordance with another aspect of the present invention, an inboard/outboard boat is made according to a method of assembling the inboard/outboard boat comprising hydraulically connecting a trim pump to a trim cylinder to form a tilt/trim assembly, installing the trim pump in a recess on a transom shield of the inboard/outboard boat, and, after hydraulically connecting the trim pump to the trim cylinder to form the tilt/trim assembly, installing the tilt/trim assembly on the inboard/outboard boat without hydraulically disconnecting the trim pump and the trim cylinder.

In accordance with yet another aspect of the present invention, a tilt/trim assembly comprises a pump, a motor for driving the pump, a hydraulic cylinder assembly including a piston defining a forward and a rear chamber of a cylinder, a forward hydraulic line connected to the forward chamber of the cylinder and in fluid communication with the pump, a rear hydraulic line connected to the rear chamber of the cylinder and in fluid communication with the pump, and a cover for the pump and the motor, the cover including a manifold for connecting the forward hydraulic line and the rear hydraulic line to the pump.

BRIEF DESCRIPTION OF THE DRAWINGS

The features and advantages of the present invention are well understood by reading the following detailed description in conjunction with the drawings in which like numerals indicate similar elements and in which.

DETAILED DESCRIPTION

Figure 1:
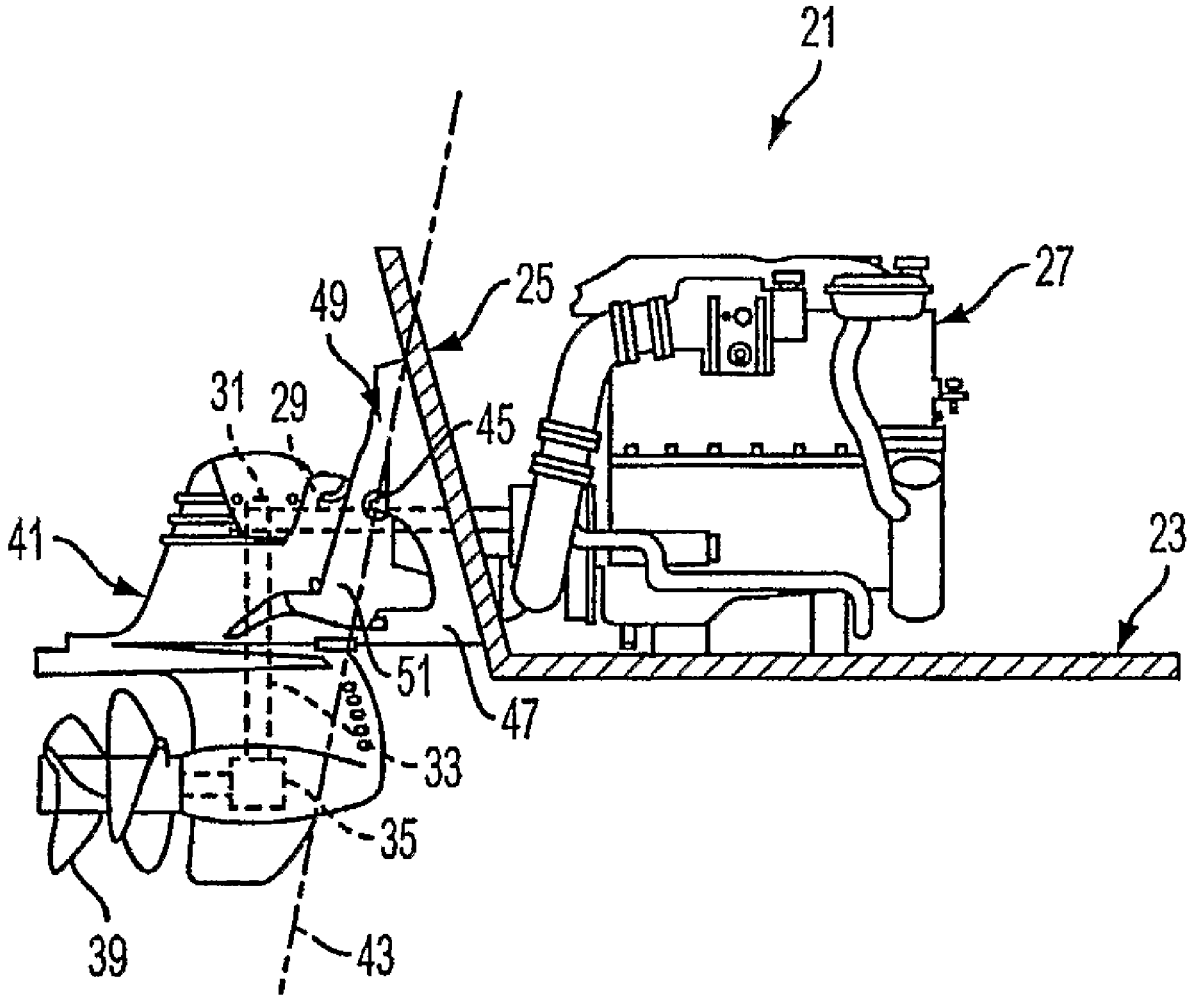
FIG. 1 is a side, partially cross-sectional view of a portion of an inboard/outboard boat according to an embodiment of the present invention.

Portions of an inboard/outboard boat 21 according to an embodiment of the present invention are shown in FIG. 1. The boat 21 includes a hull 23 and a transom 25. A drive such as an engine 27 is disposed inside the hull. In a typical drive arrangement, as seen schematically and substantially in phantom in FIG. 1, a horizontal drive shaft 29 extends from the engine 27 and is connected by a suitable gear arrangement 31 to a vertical drive shaft 33. The vertical drive shaft 33 includes a gear arrangement 35 usually including driving gear at an end thereof that drives a driven gear associated with a propeller 39. The propeller 39 typically extends rearwardly from the bottom of a stern drive unit 41 through which the vertical drive shaft 33 extends.

Figure 2:
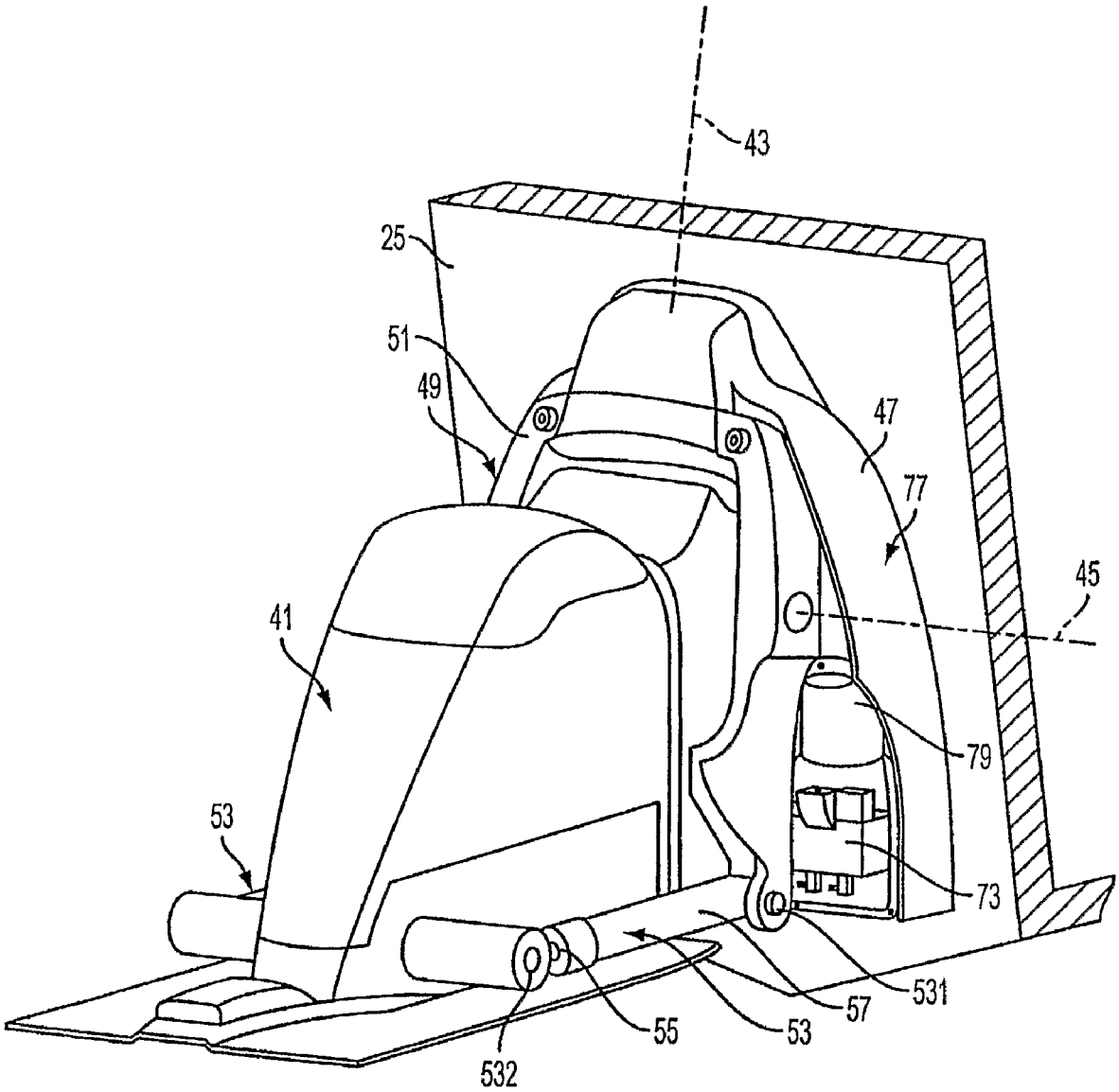
FIG. 2 is a perspective, partially cross-sectional view of a portion of an inboard/outboard boat including a stern drive unit and a transom assembly according to an embodiment of the present invention.

The stem drive unit 41 is pivotable about a generally vertical steering axis 43 to turn the boat 21 in a port or starboard direction, and is pivotable about a generally horizontal tilt/trim axis 45 to raise the propeller 39 relative to the hull 23. The horizontal drive shaft 29 typically extends through the transom 25 and a transom shield 47 mounted on and/or forming the transom. As seen in FIG. 2, a gimbal ring assembly 49 is typically attached to the transom shield 47 and includes a gimbal ring 51 that is pivotable about the steering axis 43 (FIG. 1), typically by means of controls (not shown) operated from inside the boat 21.

Figure 3:
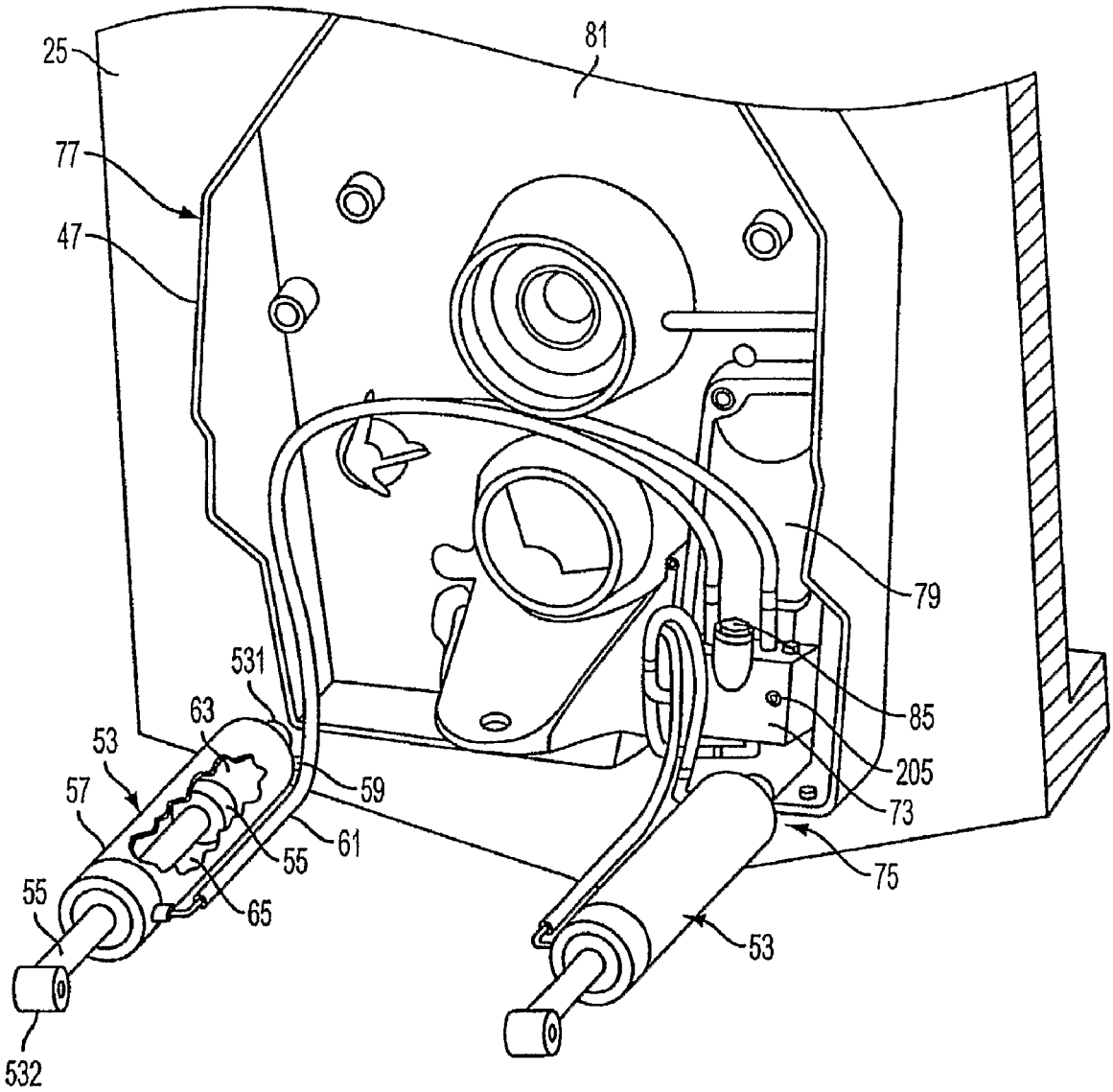
FIG. 3 is a perspective, partially broken, partially cross-sectional view of a portion of an inboard/outboard boat including portions of a transom shield assembly and a tilt/trim assembly according to an embodiment of the present invention.

The stern drive unit 41 is mounted to the gimbal ring 51 and is pivotable relative to the gimbal ring about the tilt-trim axis 45. The stern drive unit 41 is pivoted about the tilt/trim axis 45 by one or more trim cylinder assemblies 53, each trim cylinder assembly comprising a piston 55 and a cylinder 57. Typically, as seen in FIGS. 2 and 3, port and starboard trim cylinder assemblies 53 can be provided on opposite sides of the gimbal ring 51 and the stem drive unit 41 (not shown in FIG. 3). As seen in FIG. 2, a first end 531 of each trim cylinder assembly 53 is typically pivotably attached to the gimbal ring 51 and a second end 532 of the trim cylinder assembly is typically attached to the stem drive unit 41.

Typically, as seen in FIG. 3, the piston 55 of a trim cylinder assembly 53 is caused to move relative to the cylinder 57 by hydraulic pressure applied through forward and rear hydraulic lines 59 and 61 connected at one end to forward and rear pressure chambers 63 and 65, respectively, of the cylinder. The hydraulic lines 59 and 61 are typically also connected, at the other end, to a trim cylinder pump 67 (FIG. 4) that is covered by a cover 79. The pump 67 may be any suitable form of pump, such as a gear pump or a piston pump. A piston pump is illustrated in the present application and is generally smaller than a gear pump.

Figure 4:
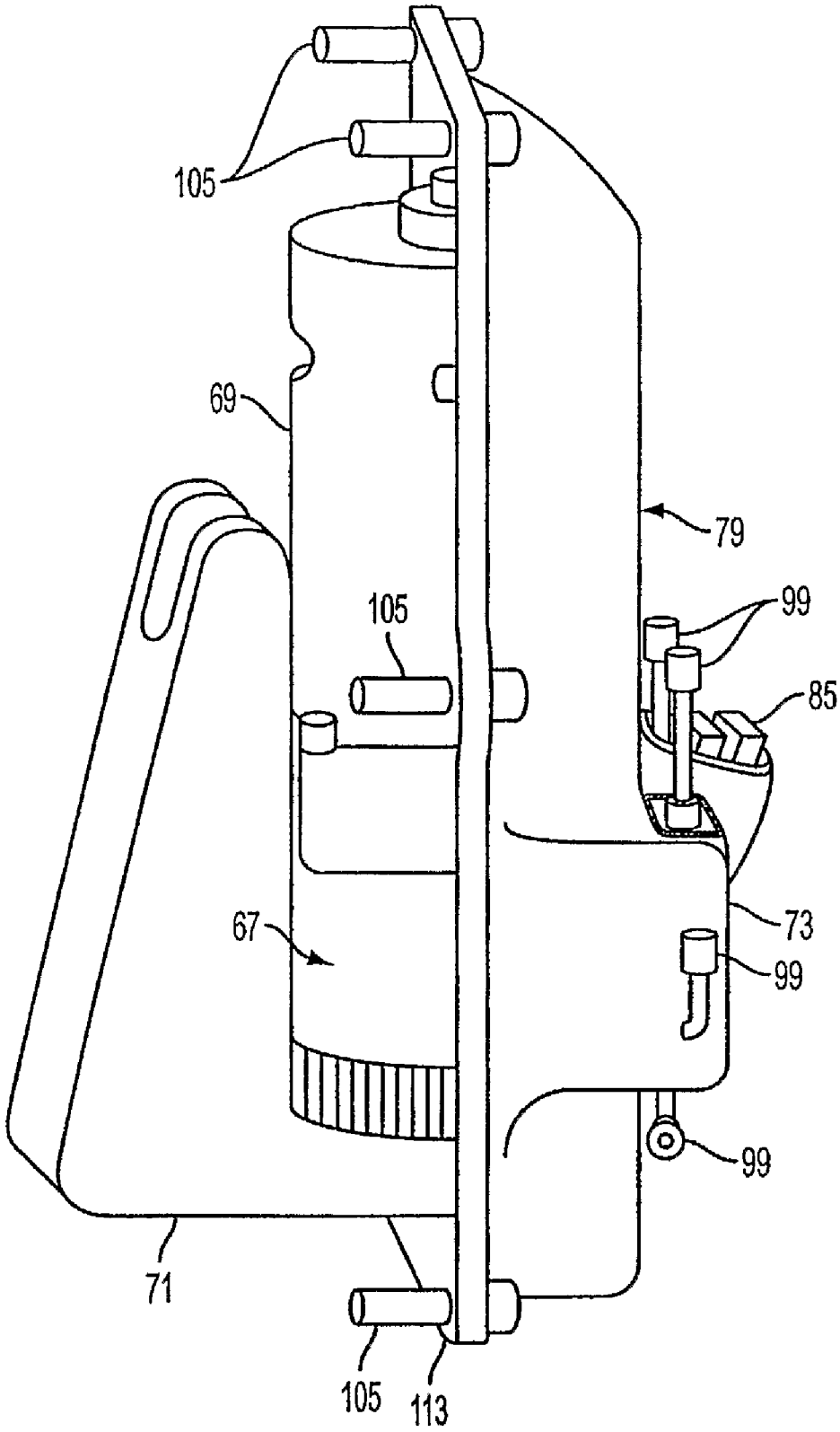
FIG. 4 is a perspective view of a cover and pump according to an embodiment of the present invention.

As seen in FIG. 4, the pump 67 is typically associated with a motor 69, typically a reversible motor, for operating the pump, and a fluid reservoir 71 for holding hydraulic fluid. The reservoir 71 can be clamped to the pump 67 by a suitable clamp (not shown), such as a hose clamp available from Oetiker, Inc., 3305 Wilson Street, Marlette, Mich., USA. The hydraulic lines 59 and 61 are typically connected to the cylinder pump 67 via a manifold 73 that is ordinarily provided in the cover 79. The shape of the cover 79 can be any suitable shape, and can be adapted to conform to other structures, such as wall portions of the transom shield 47.

Referring to FIGS. 1-4, when it is desired to raise the propeller 39 relative to the hull 23, hydraulic fluid pumped by the pump 67 from the reservoir 71 is directed through the manifold 73, through the forward hydraulic line 59, and to the forward pressure chamber 63 so that the piston 55 is moved rearwardly relative to the cylinder 57. At the same time, hydraulic fluid in the rear pressure chamber 65 flows from the rear pressure chamber, through the rear hydraulic line 61, and is directed, via the manifold 73, back to the reservoir 71.

When it is desired to lower the propeller 39 relative to the hull 23 in the illustrated embodiment, hydraulic fluid pumped by the pump 67 from the reservoir 71 is directed through the manifold 73, through the rear hydraulic line 61, and to the rear pressure chamber 65 so that the piston 55 is moved forwardly relative to the cylinder 57. At the same time, hydraulic fluid in the forward pressure chamber 63 flows from the forward pressure chamber, through the forward hydraulic line 59 and is directed, via the manifold 73, back to the reservoir 71.

In other embodiments (not illustrated), it may be desirable to arrange the piston and cylinder of the trim cylinder assembly differently. For example, instead of causing hydraulic fluid to flow to a forward pressure chamber and away from a rear pressure chamber to raise the propeller (and in the opposite directions to lower the propeller), hydraulic fluid may be caused to flow to a rear pressure chamber and away from a forward pressure chamber to raise the propeller (and in the opposite directions to lower the propeller), such as where an end of the piston is connected to the gimbal ring and an end of the cylinder is connected to the stern drive unit.

Ordinarily, the cylinder is attached to the gimbal ring and the piston attached to the stem drive because this arrangement can minimize a length of the hydraulic lines from the forward and rear pressure chambers of the cylinder to the pump. The trim cylinder 53, the forward and rear hydraulic lines 59 and 61, the pump 67, the motor 69, the reservoir 71, and the manifold 73 together all form a tilt/trim assembly 75.

Typically, the manifold 73 is provided in the cover 79, typically integral with the cover, and the tilt/trim assembly 75 includes the cover that is typically bolted to the pump 67 by bolts 205 (FIG. 3) that extend through holes 213 (FIG. 6) in the cover and mate with threaded holes 215 (FIG. 5) in the pump. By connecting hydraulic lines 59 and 61 to a pump 67 disposed on an outer side 81 of the transom shield 47, the length of hydraulic lines can be kept to a minimum, the quantity of hydraulic lines and hose fittings can be minimized (and opportunities for leaks thereby reduced), and fewer ground connections to metallic parts of the hose fittings need be made.

The transom shield 47 forms part of a transom shield assembly 77 that also includes the cover 79, attachable to the transom shield, for covering the trim pump 67 and motor 69. The cover 79 and the pump 67 and/or the motor 69 can be secured to one another, such as by screws (not shown). The manifold 73 is ordinarily integral with the cover 79. The cover 79 and the transom shield 47 can be any suitable material(s), such as die cast aluminum or plastic.

The transom shield 47 includes an outer side 81 intended to face away from an inside of the boat 21 (FIG. 1) and the cover 79 is disposed on the outer side of the transom shield. The cover 79 can cover the reservoir 71 associated with the trim pump 67 and the cover can include an oil level check hole 83 in fluid communication with the reservoir, and a member such as a plug 85 to seal the check hole. The check hole 83 can be in fluid communication with the reservoir through an opening 87 in the pump 67.

Ordinarily, a level of the check hole 83 when the cover 79 is mounted on the transom shield 47 will be vertically lower than the top of the reservoir 71 such that the reservoir will ordinarily not be entirely full and an air space will be present at the top of the reservoir. By ensuring that there is an air space at the top of the reservoir 71, the pump 67 can more easily pump fluid out of the reservoir than if the reservoir were full of hydraulic fluid because the air can expand and the air pressure of the empty volume can be reduced from normal atmospheric pressure to a lower pressure. For filling or draining the reservoir 71 through the check hole 83, another opening (not shown) can be provided in the reservoir that can be opened when it is desired to fill the reservoir to permit air to more easily escape or enter the reservoir during filling or draining. The opening can be closed when the reservoir is filled. If desired, the plug 85 can include a dip-stick for checking the hydraulic fluid level.

The transom shield assembly 77 can also include the trim pump 67, the motor 69, the reservoir 71, all of which can be covered by the cover, as well as the trim cylinder assembly 53 and hydraulic lines 59 and 61 providing fluid communication between the trim cylinder assembly and the trim pump. In this way, during assembly of the boat 21, the transom shield assembly 77 can be supplied to an assembly site in a fully sealed, fully primed, fully tested condition, with no need to disconnect and reconnect hydraulic fittings, and no need to prime hydraulic lines and remove air bubbles or contaminants. To complete the attachment of the tilt/trim assembly 75 to the boat 21, the transom shield assembly 77 is attached to the transom 25 and the ends 531 and 532 of the trim cylinder assembly 53 are attached to the gimbal ring 51 and the stem drive unit 41. Because it is not necessary to hydraulically disconnect the trim cylinder assembly 53 and the pump 67, the assembly process can be simplified and the risk of defects can be reduced.

Figure 5:
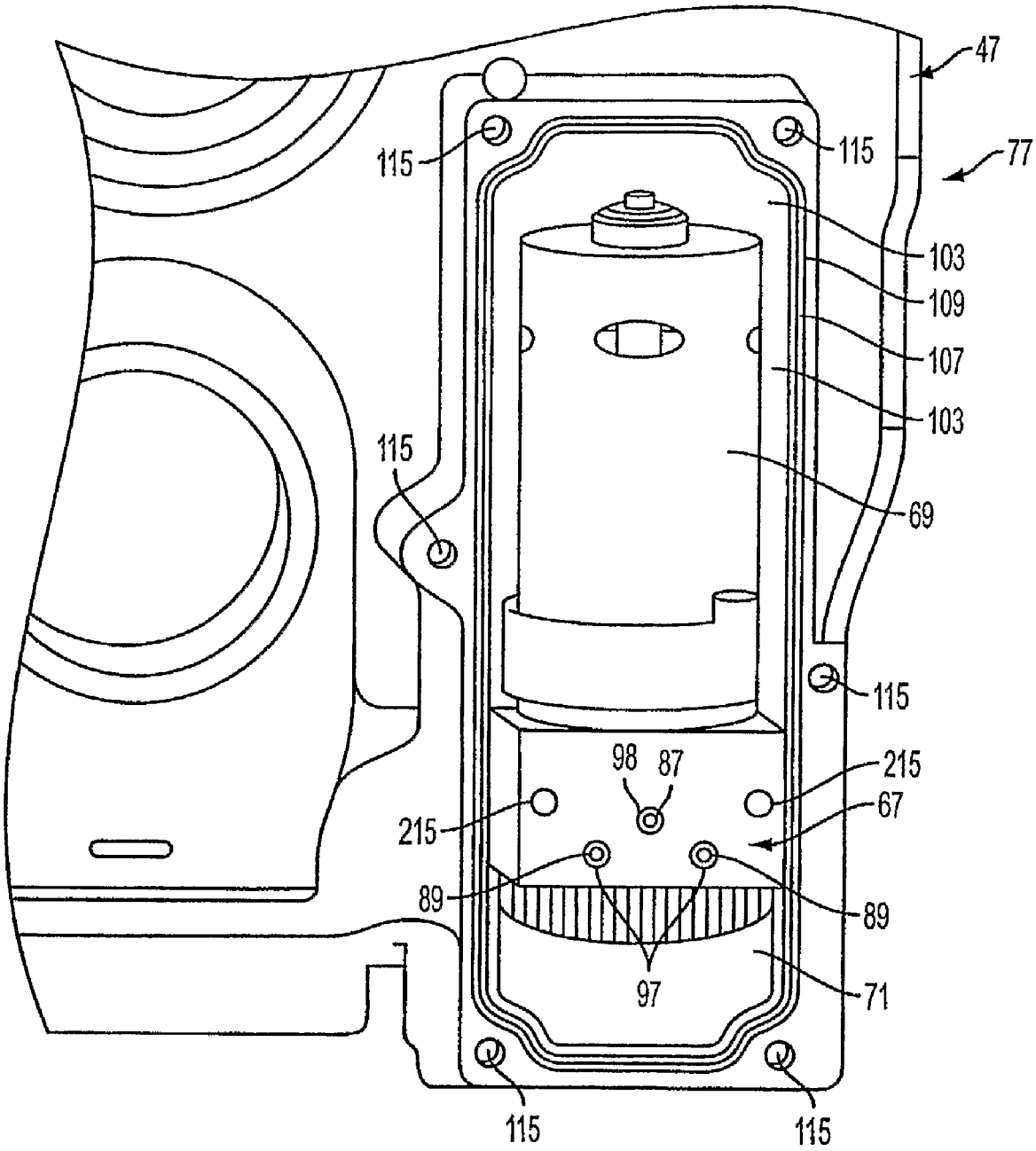
FIG. 5 is a perspective view of a pump disposed in a recess of a transom shield.
Figure 6:
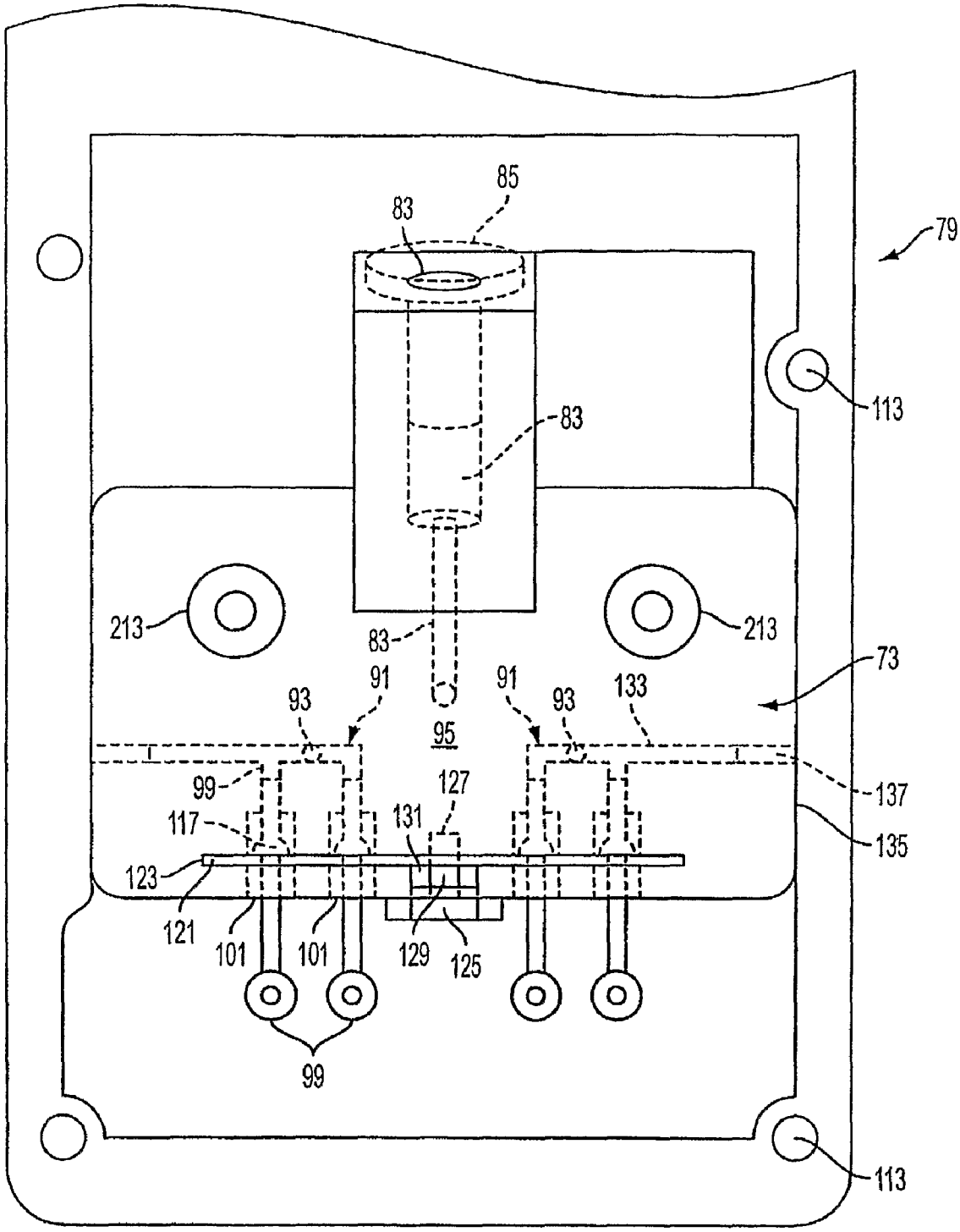
FIG. 6 is a top view of a portion of a cover according to an embodiment of the present invention.

As seen with reference to FIG. 5, which shows the trim pump 67 in a recess 103 in the transom shield 47 with the cover 79 removed, and FIG. 6, which shows part of the cover 79 including the manifold 73, the trim pump can include a plurality of ports 89, and the cover can include the manifold comprising a plurality of corresponding ports associated with conduits 91 (shown in phantom in FIG. 5), the conduits having inner ends 93 defining the ports at an inner surface 95 of the cover for mating with the trim pump ports. A seal 97, such as an O-ring seal, for sealing the trim pump ports 89 relative to the inner ends 93 of the conduits 91 can be provided. A seal 98, such as an O-ring seal, for sealing the opening 87 in the pump 67 that permits communication between the reservoir 71 and the check hole 83 at the inner surface 95 of the cover 79 can be provided.

Fittings 99, such as hose ends and clamps available from HOERBIGER Micro Fluid GmbH, Barbing, Germany, can extend past outer ends 101 of the cover conduits 91, and the forward and rear hydraulic lines 59 and 61 can be attached to appropriate ones of the fittings. The fittings 99 can include enlarged end portions 117 opposite ends 119 that mate with the hydraulic lines 59 and 61. The enlarged end portions 117 facilitate holding the fittings 99 in place relative to the conduits 91. When the fittings 99 are placed in position relative to the conduits, a plate 121 with grooves (not shown) cut into an edge of the plate is slid into a slot 123 provided in the cover. The grooved plate 121 prevents the enlarged end portions 117 and, thus, the fittings 99 from being pulled out of the conduits 91. The grooved plate 121 can be held in place relative to the cover 79 by a bolt 125 that extends through a hole in the grooved plate and mates with the hole in the plate or an internally threaded hole 127 that can be provided in the cover. A lock-nut 129 can be provided in a recess 131 in the cover to lock the bolt 125 in place.

The transom shield 47 can comprise a recess 103 adapted to receive part of one or more of, and ordinarily all of the trim pump 67, the motor 69, and the reservoir 71. The cover 79 can be formed to cover any portions of the trim pump 67, the motor 69, and the reservoir 71 that are not fully received in or covered by surfaces of the recess 103. Instead of providing a recess 103 in the transom shield 47 as shown in FIG. 5, the cover can be formed to enclose the pump, the motor, and the reservoir without the need for a recess in the transom shield.

The cover 79 is secured to the transom shield 47 in any suitable manner, ordinarily by a plurality of bolts 105 (FIG. 4) that extend through holes 113 (FIG. 4 and FIG. 6) in the cover into threaded holes 115 (FIG. 5) in the transom shield. The cover 79 and the transom shield 47 can be sealed to better protect the pump 67, the motor 69, and the reservoir 71 by any suitable seal, such as a seal 107 that sits in a groove 109 provided in a surface of the transom shield that faces a corresponding surface of the cover. The seal 107 may alternatively or additionally be disposed in a groove (not shown) provided in the cover surface.

The motor 69 for driving the pump 67 is ordinarily an electric motor. Electrical power leads (not shown) can be provided in any suitable manner, such as by passing them through an opening extending through the transom 25 and the transom shield 47 to a structure such as a control panel (not shown). Typically, the direction in which the pump 67 drives the hydraulic fluid is reversed by reversing the electrical connections to the pump, such as by a switch (not shown) that will ordinarily be disposed on the control panel. When making the transom shield assembly 77, the leads can be fed through the opening prior to sealing the motor 69 in the space defined by the transom shield 47 and the cover 79. On the inner side of the boat 21, the opening will ordinarily be sealed, such as by a conduit and/or a suitable form of sealing material, such as an elastic plug material or grommet for strain relief, through which the leads extend. Thus, the pump 67, the motor 69, and the reservoir 71 can all be entirely sealed in the space defined by the cover and the transom shield, thereby decreasing the risk of damage to those components through exposure to the elements.

The conduits 91 in the manifold 73 in the cover 79 can take any suitable form. In the embodiment shown in FIG. 6, two conduits 91 each include a single inner end 93 and two outer ends 101. The inner end 93 can connect to the outer ends 101 by an intermediate conduit portion 133. Conduit portions extending into the cover 79 from the inner end 93 and the outer ends 101 can be, e.g., drilled and can connect to the intermediate conduit portion 133 which can also be drilled. In the embodiment of FIG. 6, the conduit portion from the inner end 93 is drilled horizontally from the inner surface 95 of the cover 79 to a depth and the conduit portions from the outer ends 101 are drilled vertically from a bottom of the manifold 73 to a depth such that the intermediate conduit portion 133 intersects the drilled conduit portions substantially at the depth to which they are drilled. The outside end 135 of the intermediate conduit portion 133 can be plugged with a suitable plug 137, such as epoxy.

FIG. 6 and FIG. 2 show all of the fittings 99 extending from a bottom of the manifold 73. Other arrangements can be provided as desired. For example, as seen in FIGS. 3 and 4, some fittings 99 may extend from the side of the manifold 73, some from the bottom, and some from the top. Different arrangements may be desirable for reasons such as better space economy or efficiency in permitting for hydraulic tubing connections.

In a method of assembling an inboard/outboard boat 21, the trim pump 67 is hydraulically connected to a trim cylinder 53 to form a tilt/trim assembly 75. After the trim pump 67 is hydraulically connected to the trim cylinder 53, the tilt/trim assembly 75 is installed on the inboard/outboard boat 21 without hydraulically disconnecting the trim pump and the port and starboard trim cylinders.

Usually, but not necessarily, after installing the tilt/trim assembly 75 on the boat, a first end 531 of the trim cylinder 53 is secured to a gimbal assembly 49, and a second end 532 of the trim cylinder is secured to a stern drive unit 41. The gimbal assembly 49 is secured to the transom shield 47, usually, but not necessarily, before installing the tilt/trim assembly 75. Usually after securing the gimbal assembly 49 to the transom shield 47, and usually before installing the tilt/trim assembly 75, but not necessarily in either case, the gimbal assembly is secured to the stern drive unit 41.

Ordinarily, when installing the tilt/trim assembly 75 on the boat, the trim pump 67 is installed in a recess 103 on the transom shield 47. The cover 79 is mounted over the trim pump 67 and, ordinarily, the trim pump and the trim cylinder 53 is hydraulically connected through a manifold 73 including conduits 91 provided in the cover.

According to an embodiment of the present invention, the tilt/trim assembly 75 includes the pump 67, the motor 69, the trim cylinder 53, the forward and rear hydraulic lines 59 and 61, and the cover 79, the cover including a manifold 73 for connecting the forward hydraulic line and the rear hydraulic line to the pump. The manifold 73 can be integral with the cover 79, although the manifold need not be integral the cover and may, for example, simply be attached to the pump 67, or to the cover 79, or at some other location. The tilt/trim assembly 75 will also ordinarily include the reservoir 71 in fluid communication with the pump 67, and the cover 79 will ordinarily cover the reservoir.

The invention has been described in connection with a suspension system wherein a drive unit is mounted on a gimbal ring that is pivotable about a substantially vertical axis, and wherein the drive unit is pivotable relative to the gimbal ring about a substantially horizontal axis. It will be understood that this description is merely illustrative, not limiting, and that the present invention can be used in other applications, as well. For example, other suspension systems with which the present invention is usable include suspension systems of the type wherein the drive unit is mounted to a yoke that is pivoted relative to the transom shield about a horizontal axis during trim. Instead of pivoting together with a gimbal ring about a vertical axis during turning, the yoke does not pivot about a vertical axis during turning. Instead, the drive unit can be pivoted about a substantially vertical axis defined by a substantially vertical shaft during turning, and the trim cylinders can be attached between the yoke and the transom shield. In a boat having such a suspension system, the transom shield assembly can include a cover for covering a trim pump in substantially the same manner as the transom shield assembly described in connection with the suspension system including a gimbal ring, and the method for making a boat with such a suspension system is, with respect to the present invention, substantially the same as the method for making a boat with a suspension system including a gimbal ring.

In the present application, the use of terms such as "including" is open-ended and is intended to have the same meaning as terms such as "comprising" and not preclude the presence of other structure, material, or acts. Similarly, though the use of terms such as "can" or "may" is intended to be open-ended and to reflect that structure, material, or acts are not necessary, the failure to use such terms is not intended to reflect that structure, material, or acts are essential. To the extent that structure, material, or acts are presently considered to be essential, they are identified as such.

While this invention has been illustrated and described in accordance with a preferred embodiment, it is recognized that variations and changes may be made therein without departing from the invention as set forth in the claims.

What is claimed is:

1. A transom shield assembly adapted to be coupled to a transom of an inboard/outboard boat, comprising:

a transom shield;

a trim pump; and a cover, attachable to the transom shield, covering the trim pump, wherein the trim pump includes a plurality of ports, the cover including a plurality of corresponding ports for mating with the trim pump ports.

2. The transom shield assembly as set forth in claim 1, wherein the transom shield includes an outer side intended to face away from an inside of the boat, the cover being disposed on the outer side of the transom shield.

3. The transom shield assembly as set forth in claim 1, wherein the cover is adapted to cover a reservoir associated with the trim pump.

4. The transom shield assembly as set forth in claim 3, comprising the reservoir.

5. The transom shield assembly as set forth in claim 4, wherein the cover includes an oil level check hole in fluid communication with the reservoir.

6. The transom shield assembly as set forth in claim 5, wherein the oil level check hole is in fluid communication with the reservoir along a path extending through the trim pump.

7. The transom shield assembly as set forth in claim 1, comprising at least one seal for sealing trim pump ports and corresponding cover ports.

8. The transom shield assembly as set forth in claim 7, wherein the at least one seal comprises an O-ring seal sealing each of the trim pump ports and the corresponding cover ports.

9. The transom shield assembly as set forth in claim 1, comprising port and starboard trim cylinders in fluid communication with the trim pump.

10. The transom shield assembly as set forth in claim 1, wherein the transom shield comprises a recess adapted to receive the trim pump.

11. The transom shield assembly as set forth in claim 10, wherein the transom shield comprises a recess adapted to receive a reservoir associated with the trim pump.

12. An inboard/outboard boat comprising the transom shield assembly of claim 1.

13. A method of assembling an inboard/outboard boat, comprising:

a) hydraulically connecting a trim pump to a trim cylinder to form a tilt/trim assembly;

b) installing the trim pump in a recess on a transom shield of the inboard/outboard boat;

c) after step a), installing the tilt/trim assembly on the inboard/outboard boat without hydraulically disconnecting the trim pump and the trim cylinder;

d) mounting a cover over the trim pump in the recess on the transom shield; and e) securing a first end of the trim cylinder to a gimbal assembly, and securing a second end of the trim cylinder to a stern drive unit.

14. The method of assembling an inboard/outboard boat as set forth in claim 13, comprising securing the gimbal assembly to a transom shield.

15. The method of assembling an inboard/outboard boat as set forth in claim 14, comprising securing the gimbal assembly to the stern drive unit.

16. The method of assembling an inboard/outboard boat as set forth in claim 13, comprising securing the gimbal assembly to the stern drive unit.

17. The method of assembling an inboard/outboard boat as set forth in claim 13, comprising hydraulically connecting the trim pump and the trim cylinder through the cover.

18. An inboard/outboard boat made according to the method of claim 13.

19. A tilt/trim assembly, comprising:

a pump;

a motor for driving the pump;

a hydraulic cylinder assembly including a piston defining a forward and a rear chamber of a cylinder;

a forward hydraulic line connected to the forward chamber of the cylinder and in fluid communication with the pump;

a rear hydraulic line connected to the rear chamber of the cylinder and in fluid communication with the pump; and a cover that covers the pump and the motor, the cover including a manifold for connecting the forward hydraulic line and the rear hydraulic line to the pump.

20. The tilt/trim assembly as set forth in claim 19, wherein the manifold is integral with the cover.

21. The tilt/trim assembly as set forth in claim 19, comprising a reservoir in fluid communication with the pump.

22. The tilt/trim assembly as set forth in claim 21, wherein the cover covers the reservoir.

23. A method of assembling an inboard/outboard boat, comprising:

a) hydraulically connecting a trim pump to a trim cylinder to form a tilt/trim assembly;

b) installing the trim pump in a recess on a transom shield of the inboard/outboard boat;

c) after step a). installing the tilt/trim assembly on the inboard/outboard boat without hydraulically disconnecting the trim pump and the trim cylinder;

d) mounting a cover over the trim pump in the recess on the transom shield; and e) connecting ports on the trim pump to corresponding ports on the cover.

* * * * *